US006015342A

United States Patent [19]

Dennis

[11] Patent Number: 6,015,342

[45] Date of Patent: Jan. 18, 2000

[54] LOUVER APPARATUS FOR AIR CONDITIONING UNIT

[75] Inventor: Richard D. Dennis, Bridgeport, N.Y.

[73] Assignee: Carrier Corporation, Farmington, Conn.

[21] Appl. No.: 09/089,802

[22] Filed: Jun. 3, 1998

[51] Int. Cl.[7] ..... F24F 7/00

[52] U.S. Cl. ..... 454/316; 454/313; 454/155

[58] Field of Search ..... 454/316, 313, 454/314, 315, 320, 321, 202, 155

[56] References Cited

U.S. PATENT DOCUMENTS

| | | | |
|---|---|---|---|
| 3,636,854 | 1/1972 | Cary | 454/315 |
| 3,736,858 | 6/1973 | Mercier | 454/315 |
| 4,345,510 | 8/1982 | Sterett | 454/315 |
| 4,377,107 | 3/1983 | Izumi | 98/40 V |
| 4,653,386 | 3/1987 | Hayakawa et al. | 454/315 |
| 4,777,870 | 10/1988 | Bolton et al. | 98/40.24 |
| 5,039,008 | 8/1991 | Sugawara et al. | 236/49.3 |
| 5,188,561 | 2/1993 | Nissimoff et al. | 454/256 |
| 5,299,978 | 4/1994 | Dennis et al. . | |
| 5,573,458 | 11/1996 | Chu | 454/315 |
| 5,588,910 | 12/1996 | Hutter et al. | 454/154 |
| 5,658,197 | 8/1997 | Kil | 454/319 |

*Primary Examiner*—Harold Joyce
*Assistant Examiner*—Derek S. Boles
*Attorney, Agent, or Firm*—Wall Marjama Bilinski & Burr

[57] ABSTRACT

Apparatus for deflecting the flow of supply air discharged from an air conditioning unit that includes a stationary frame mounted in the discharge duct of the unit cabinet. An inner frame is pivotally mounted within the outer frame. The inner frame contains horizontally aligned and vertically aligned louvers mounted therein. A remotely controlled motor is coupled to the inner frame for tilting the inner frame upwardly or downwardly to selectively direct the flow of supply air leaving the unit. The unit can be adapted for manual adjustment of the louvers by removing the motor and locking the inner frame to the outer frame.

4 Claims, 6 Drawing Sheets

LOUVER APPARATUS FOR AIR CONDITIONING UNIT

BACKGROUND OF THE INVENTION

This invention relates to air conditioning, and in particular, to a louver assembly for selectively directing conditioned air into a desired comfort zone.

Many air conditioning units are equipped with adjustable louvers that can be manually positioned to direct the flow of conditioned air into a specific comfort region to provide for the reflective heating or cooling. Typically, the units contain two sets of louvers. One set contains a plurality of horizontally aligned vanes which can be positioned to direct the discharged air stream upwardly, downwardly or straight ahead. The second set of louvers which are generally mounted behind the first set can be positioned to direct the air stream to one side or the other of the unit or again straight ahead. The manually positionable louvers are frictionally retained in a mounting frame located in the discharge duct of the unit so that the louvers will remain in the desired preset position against the force of the supply air stream.

In U.S. Pat. No. 5,299,978 there is disclosed a mechanism that is adapted to angularly displace a pair of adjacent horizontally disposed louver vanes to increase or decrease the width of the flow path between the vanes and thus increase or decrease the flow velocity of the supply air. Adjusting the angular relationship between the blades does little to effect the direction of the supply air stream and the motor driven system, in effect, limits the range of adjustability of the horizontally aligned louvers.

In many air conditioning applications and, in particular heat pump applications, it is desirous to provide the discharge louvers with a wide range of adjustability. For example, it may be advantageous to direct a flow of cooling air upwardly toward the ceiling of a room to thoroughly mix with the hot air in the room and thus produce more rapid cooling. By the same token, it may be more efficient to direct a flow of heated air downwardly toward the floor of the comfort zone. Oftentimes, however, the air conditioning unit is situated, such as, at the ceiling of the comfort zone so that manual adjustment of the louvers cannot be readily accomplished.

SUMMARY OF THE INVENTION

It is therefore an object of the present invention to improve air conditioning units.

It is a further object of the present invention to provide a remotely controlled louver positioning system for an air conditioning unit.

A still further object of the present invention is to provide a louver system for an air conditioning unit wherein the louvers can be both manually adjusted and remotely adjusted by a motor driven mechanism.

Another object of the present invention is to provide a ceiling mounted air conditioning unit having remotely controlled louvers for selectively directing the flow of conditioned air discharged from the unit.

These and other objects of the present invention are attained by apparatus for directing a flow of conditioned air leaving an air conditioning unit that includes a cabinet for housing the unit having a stationary frame mounted within the discharge duct of the cabinet. An inner movable frame is pivotally mounted within the stationary frame so that the inner frame can be pivoted about a horizontal axis. The inner frame further includes a series of spaced apart horizontally aligned louvers for directing the flow of supply air leaving the air conditioning unit. A control motor is coupled to the inner frame that selectively positions the inner frame within the outer frame to direct the stream of conditioned air discharged from the unit into a desired comfort region. The louvers mounted inside the inner frame can also be manually adjusted to provide for closer control over the air flow leaving the unit. The inner frame can furthermore be locked by a suitable mechanism to the outer frame and the motor eliminated when the unit is intended for use in locations where the louvers can be easily adjusted manually.

BRIEF DESCRIPTION OF THE DRAWINGS

For a better understanding of these and other objects of the present invention, reference will be made to the detailed description of the present invention which is to be read in association with the accompanying drawings, wherein.

DESCRIPTION OF THE INVENTION

Figure 1:
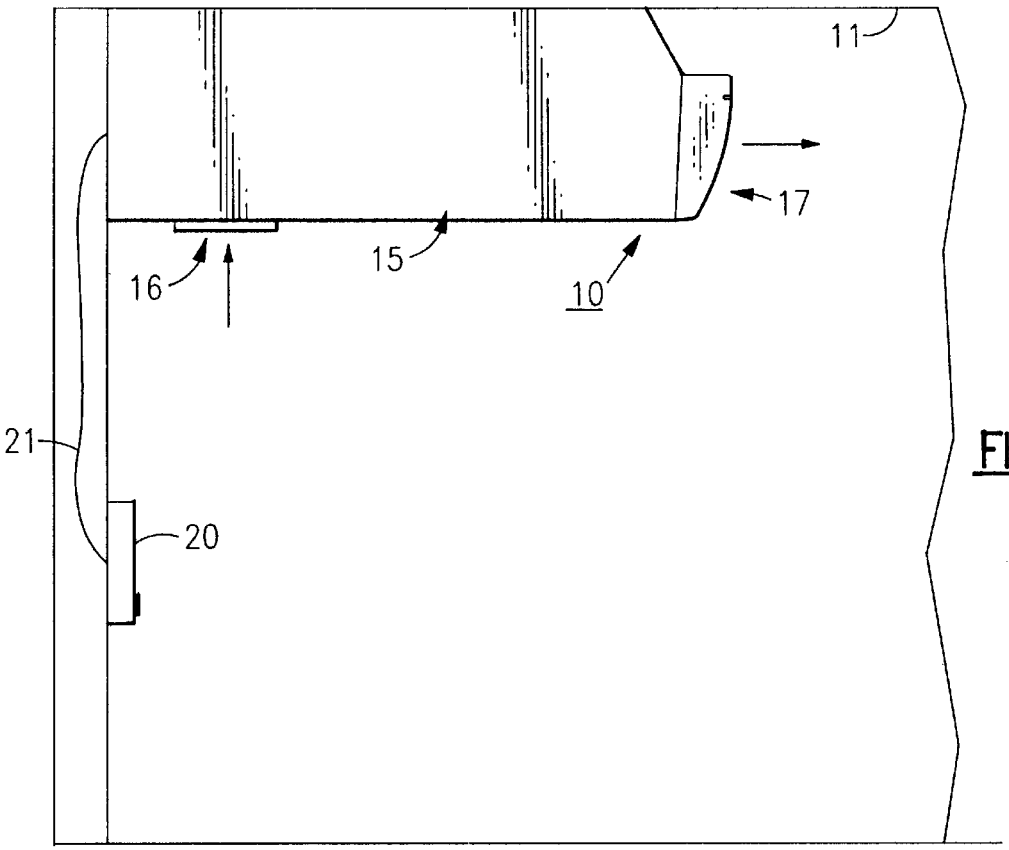
FIG. 1 is a partial side elevation illustrating a remotely located air conditioning unit embodying the teachings of the present invention.

Turning now to the drawings where like numbers are used to identify like components, the present invention involves an air distribution system that is ideally suited for use in an air conditioning unit where the unit is situated in a location that is not readily accessible. As illustrated in FIG. 1, the air conditioning unit, generally referenced 10, may be mounted in the ceiling 11 of a comfort region such as an indoor room 13 or any other similar area. The unit may be a cooling unit or a heat pump for providing both heating and cooling. The unit is housed with a cabinet 15 that is secured to a suitable support element associated with the ceiling substrate. The cabinet has a return air duct at 16 and a supply air duct at 17.

Typically, ceiling units of this nature are mounted at an elevation such that the louvers associated with the supply air duct are difficult to reach and manually adjust. This is particularly troublesome when the unit is a heat pump, the function of which is periodically changed depending upon the climatic demand load placed upon the system. As noted above, when cool air is being delivered to the conditioned region, the louvers may be adjusted to direct the flow of supply air at a relatively high trajectory to cool the warmer air within the conditioned area and drive the hot air toward the return air duct. Conversely, the trajectory of the supply air can be lower when heating is called for to more effectively heat the cooler air nearer the floor.

As will be explained in greater detail below, the positioning of louvers associated with the supply air duct can be manually adjusted or remotely adjusted through means of a motor mechanism. The motor unit is electrically connected to a wall mounted control panel 20 via wires 21 that run inside the walls of the structure or alternately controlled by an infrared system.

Figure 2:
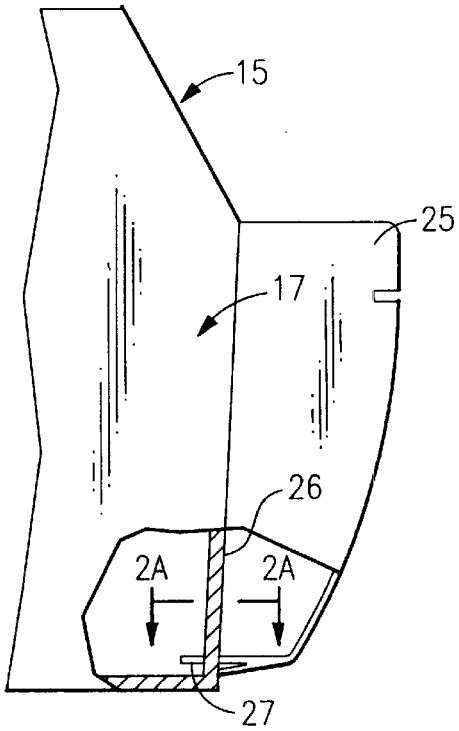
FIG. 2 is an enlarged partial side view of the remotely located unit shown in FIG. 1 further illustrating the air discharge duct of the unit cabinet.
Figure 2A:
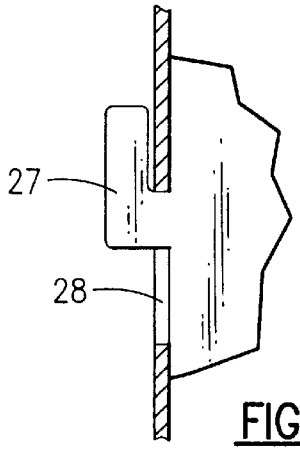
FIG. 2*a* is an enlarged sectional view taken along lines 2*a*—2*a* in FIG. 2 further illustrating one of the chips used to secure the discharge duct cover to the unit cabinet.

With specific reference to FIGS. 4–7, the supply air duct 17 includes a stationary outer frame 25 that is mounted within the duct opening 26 of the cabinet 15. The outer frame is attached to the cabinet by means of a series of hook-type fasteners 27 (FIG. 2*a*) that are adapted to pass through suitable slotted holes 28 formed in the cabinet walls so that the frame can be snap-fitted within the supply air duct. An inner frame 30 is mounted for rotation within the outer frame by means of trunnions 31 that are journalled for rotation in the outer frame. Accordingly, the inner frame can be rocked on the trunnions about a horizontal axis to tilt the inner frame upwardly or downwardly through a wide arc of travel.

A series of spaced apart horizontally aligned louvers 35—35 are mounted within the inner frame. The horizontally disposed louvers are preferably rotatably mounted between the sidewalls of the inner frame so that the louvers can be manually positioned within the frame to provide for additional adjustment of the louvers. Although not shown, friction washers are placed over pivot pins supporting the louvers which provide a sufficient retarding action so that the louvers will remain in place against the air stream moving through the supply air once the louvers are set. Alternatively, the louvers can be formed integrally with the inner frame.

Figure 5:
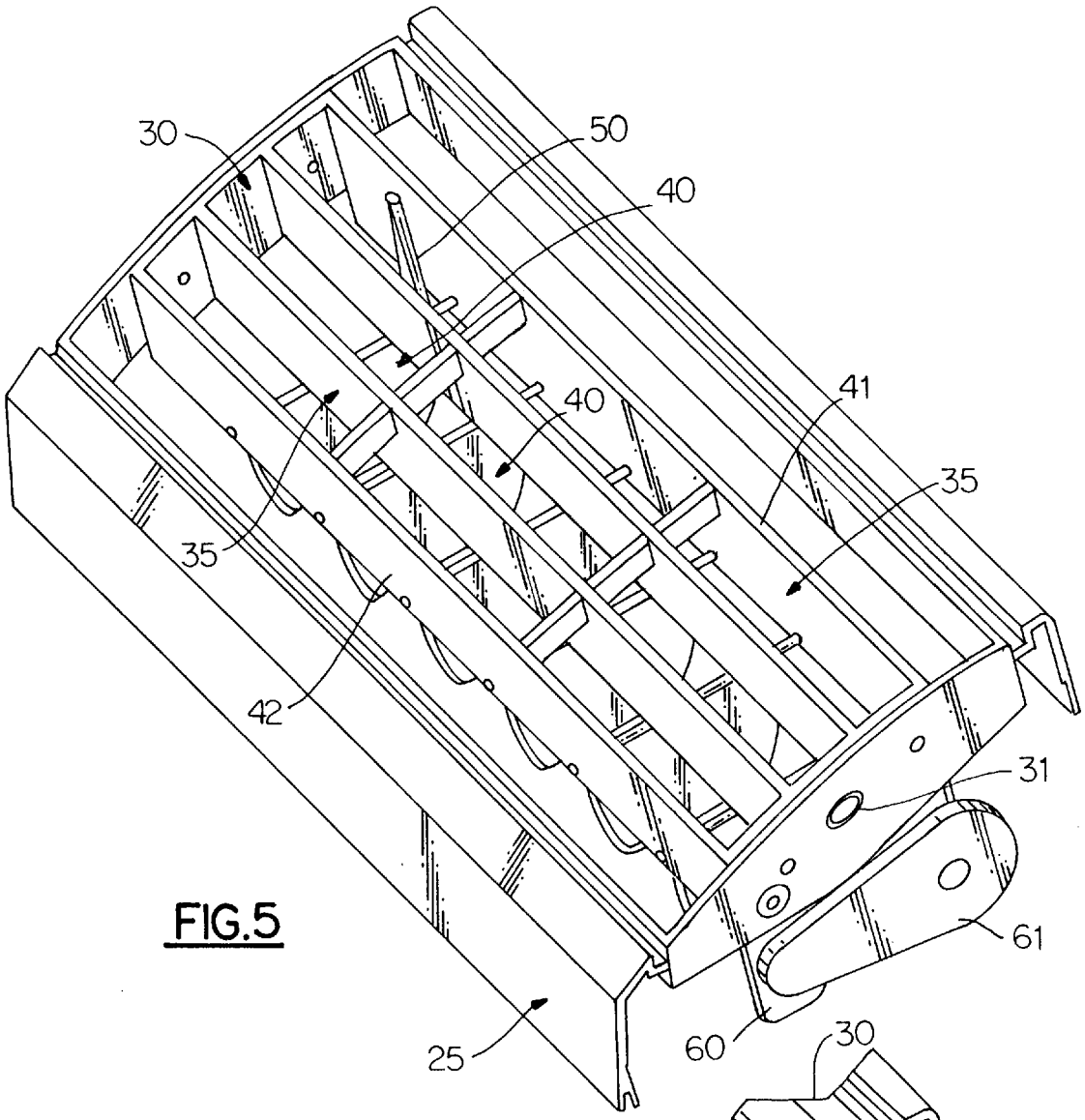
FIG. 5 is also a perspective view showing a drive motor for selectively positioning the inner frame of the duct cover within the outer frame of the cover.
Figure 8:
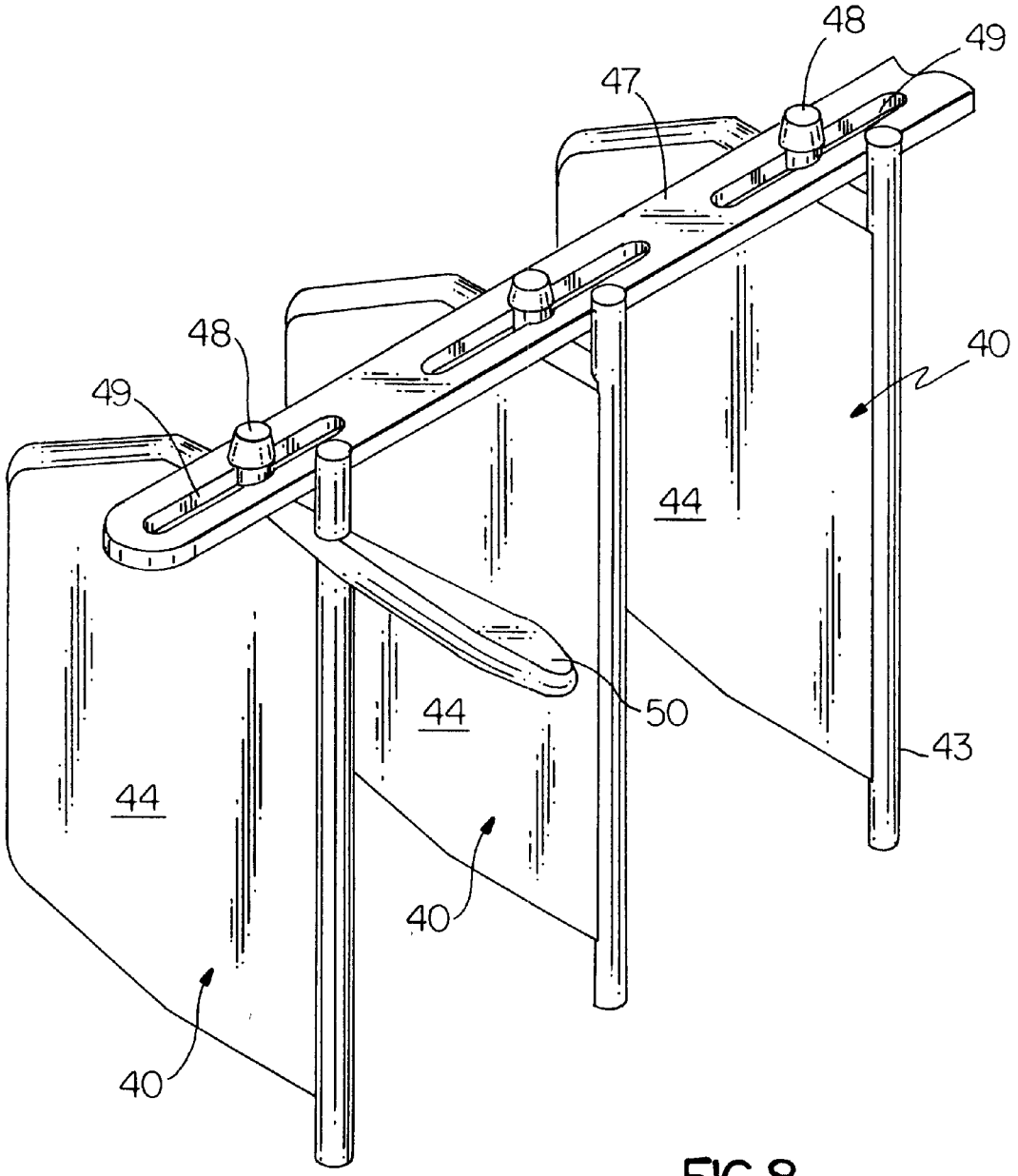
FIG. 8 is a partial perspective view showing a series of vertically aligned louvers and associated linkage for manually positioning the vertically disposed louvers within the inner frame.

As illustrated in FIGS. 5 and 8, a series of vertically aligned louvers 40 are rotatably mounted behind the horizontal louvers between the top and bottom walls 41 and 42, respectively, of the inner frame. Each louver includes a vertical shaft 43 extending along the front edge of the louver blade 44. The shafts are rotatable in the top and bottom walls of the inner frame so that the blade can be rotated about the shafts to set the louvers at a desired angle to deflect the supply air flow toward one side or the other of the unit. The louvers are connected by means of a common link 47. The link is coupled to the top edge of each louver by means of a pin 48 that passes upwardly through a slotted hole 49 provided in the link. One of the louvers, preferably the end louver in the series, is furnished with a lever arm 50 which protrudes through the horizontal louvers, as shown in FIG. 5, so that it can be hand engageable from the front of the unit to manually adjust the position of each of the louvers connected to the link uniformly. Again, friction washers or the like are associated with the vertical shaft of each louver to hold the louvers in the preset position against the stream of supply air passing through the louvers.

The entire inner frame can be moved or rocked inside the stationary outer frame by use of a motor 55. The motor can be a stepping motor or the like that is able to incrementally adjust the position of the inner frame in response to an input placed in the control box 20 (FIG. 1). A drive motor suitable for this purpose is commercially available through Eaton Controls Division, model number 417-616-21.

Figure 6:
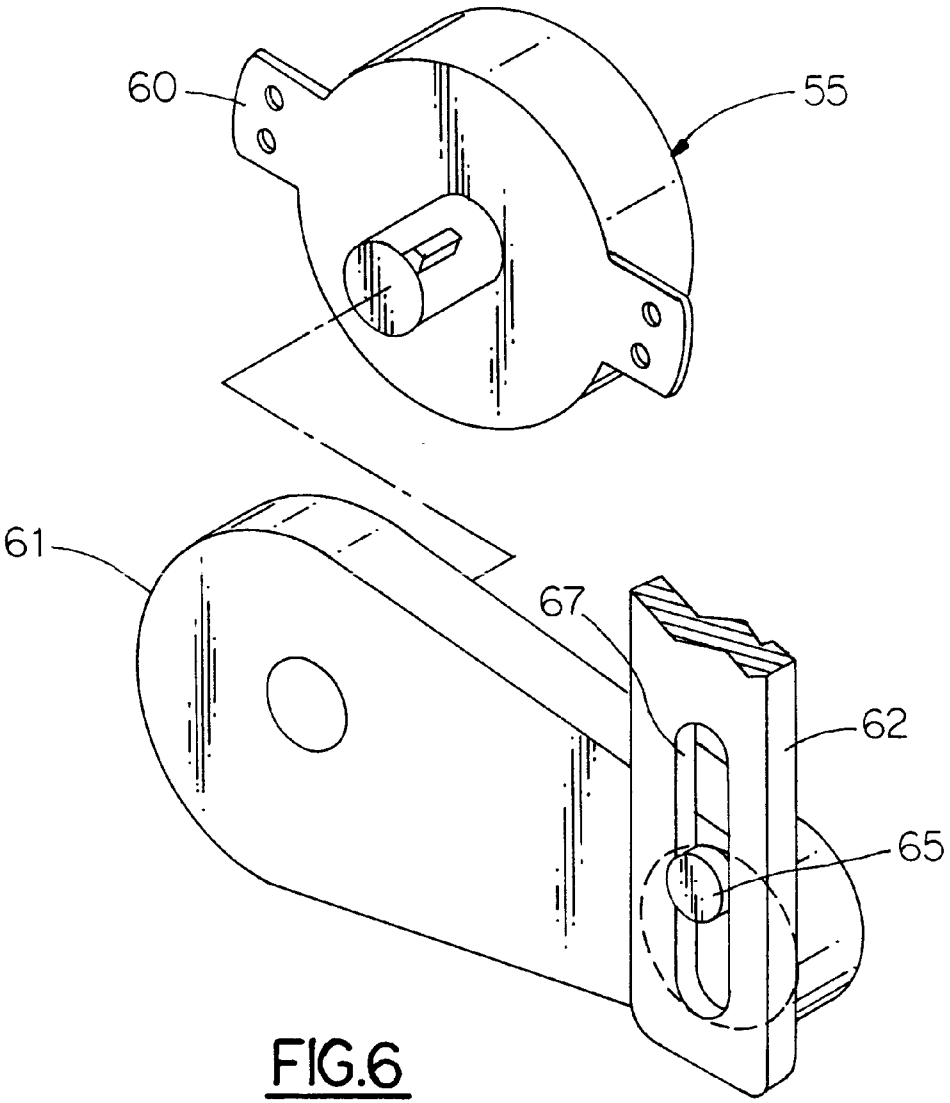
FIG. 6 is an enlarged exploded view in perspective showing the motor driven mechanism for positioning the inner frame of the air flow directing apparatus with the outer frame.

The motor contains a mounting bracket 60 which, in turn, is secured to the unit cabinet or to the stationary outer frame to hold the motor in a stationary condition. As best seen in FIG. 6, the motor shaft is connected to a rocker arm 61 secured to the inner frame by means of a link 62. The distal end of the link contains a pin 65 that is slidably contained within a slotted hole 67 provided in the lever arm. As should be evident, rotating the motor shaft to a desired position causes the link to move the rocker arm, thus turning the inner frame to a desired position. Accordingly, the inner frame can be tilted upwardly and downwardly through a wide arc of between 150° to 170°.

Figure 3:
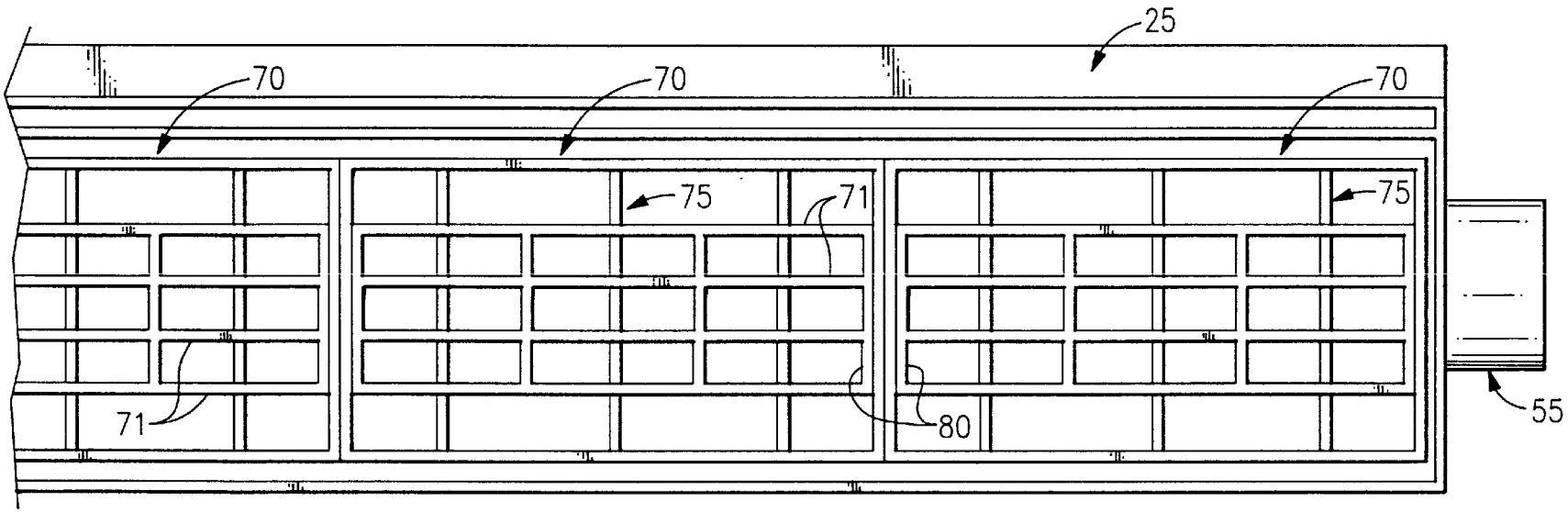
FIG. 3 is a partial front view of the duct cover shown in FIG. 2.
Figure 4:
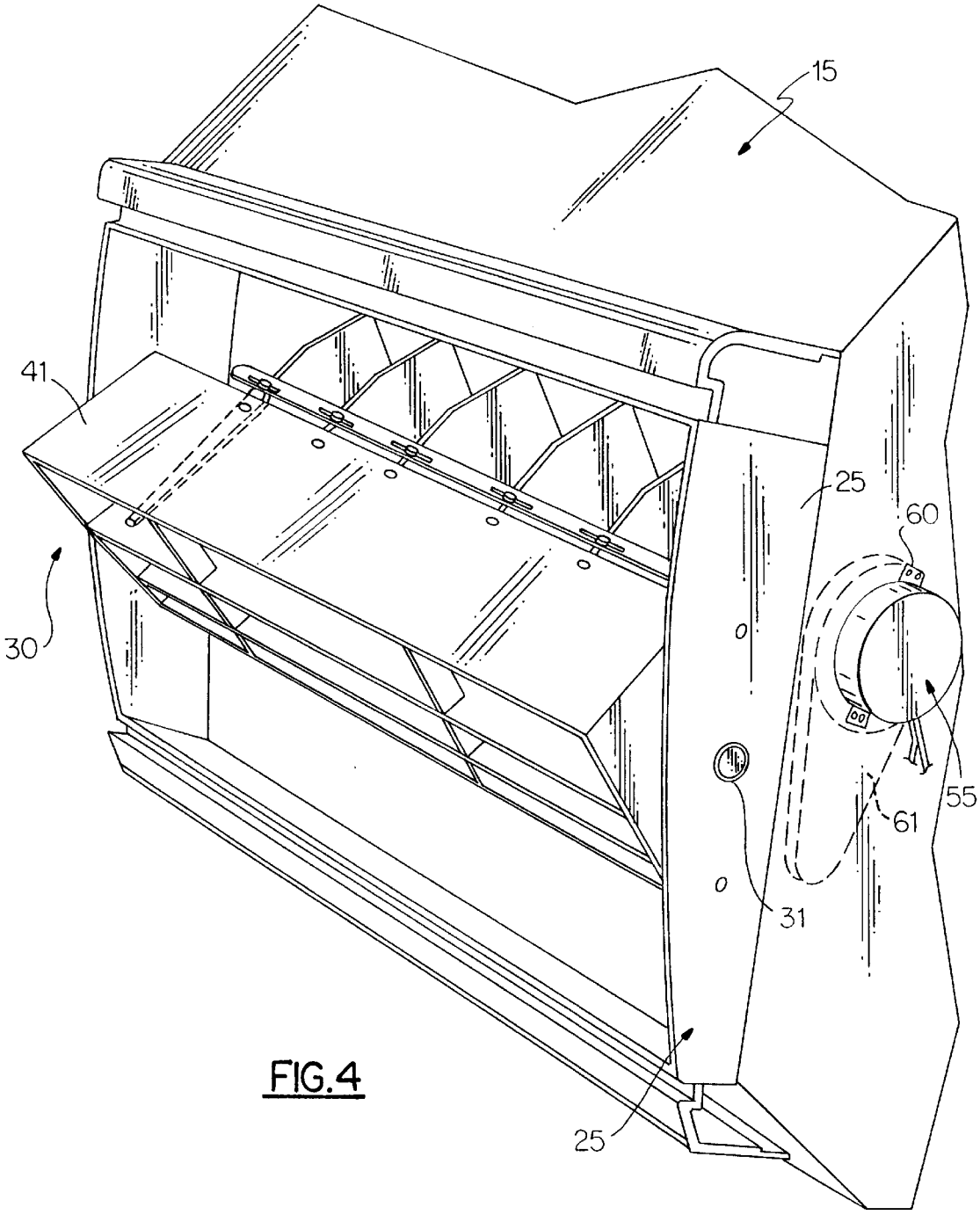
FIG. 4 is a partial perspective view showing the duct cover of the unit in further detail.

As described above, the horizontal louver blades may extend across the entire width of the inner frame. However, in larger capacity units it is advantageous to install a series of inner frame modules 70 in side-by-side alignment within the stationary outer frame as illustrated in FIG. 3. Each module contains a series of spaced apart horizontal louvers 71 extending across the width of the module frame. A series of vertically aligned louvers 75, as described above, are positioned between the top and bottom walls of the module frame behind the horizontal louver blades. The adjacent side walls 80 of adjacent modules are locked together by any suitable means and the two end modules in the array are rotatably supported in the end walls of the outer frame. Again, the motion of the module array is controlled through a motor as explained above. As can be seen, the modules can be used to create different size grills to accommodate units of varying capacities.

Figure 7:
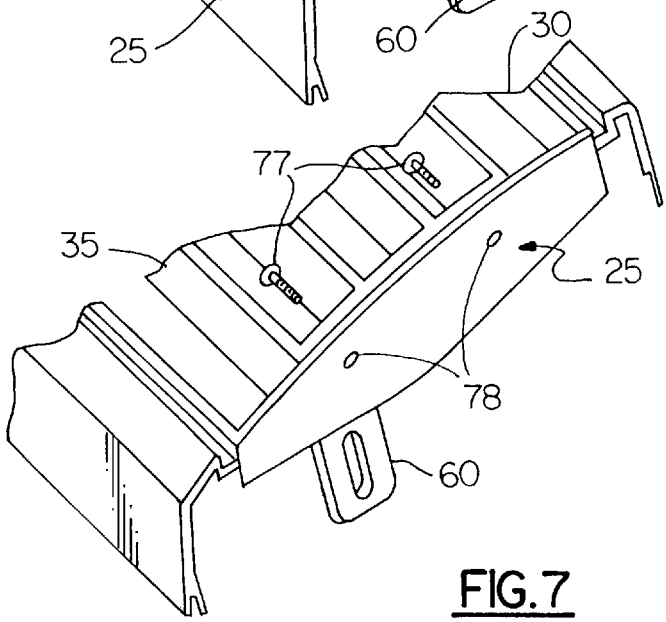
FIG. 7 is a partial perspective view of the air flow directing apparatus shown in FIG. 5 with the motor eliminated and the inner frame locked to the outer frame.

Certain markets may not require units containing remotely controlled, n adjusting systems as described above, but rather a simple manually operated louver system. To this end, the motor and the motor link is eliminated from the unit as illustrated in FIG. 7, and the inner frame is locked to the stationary outer frame by a plurality of threaded fasteners 77. The fasteners are passed through clearance holes provided in the inner frame and threaded into tapped holes 78 in the stationary outer frame. When locked in place, the horizontal axis of the inner frame is coaxially aligned with the horizontal axis of the outer frame. The flow of supply air discharged from the unit is controlled by manually adjusting the horizontal and vertical louvers again, as explained above.

While this invention has been explained with reference to the structure disclosed herein, it is not confined to the details set forth and this invention is intended to cover any modifications and changes as may come within the scope of the following claims:

What is claimed is:

1. Apparatus for deflecting conditioned air that is being discharged from an air conditioning unit into a comfort zone that includes:

an air conditioner cabinet that contains a duct through which conditioned supply air is discharged into a comfort zone;

a stationary outer frame mounted within said duct;

a movable inner frame pivotally supported within the outer frame so that said inner frame rotates about a horizontal axis;

an incrementally positionable motor mounted in said cabinet having a drive shaft;

a lever arm connected at one end to said drive shaft; the movable frame, the operable length of the link being adjustable so that the motion of the inner frame can be regulated within a given range on motion;

louver means mounted within said inner frame for deflecting the flow of air passing therethrough; and control means for remotely controlling the motor to selectively position said inner frame within said given range of motion.

2. The apparatus of claim 1 wherein said positionable motor is a stepper motor.

3. The apparatus of claim 2 wherein said motor is removably mounted in said cabinet and further includes fastener means for locking the inner frame to the outer frame when the motor is removed from the cabinet.

4. The apparatus of claim 3 wherein said louver means includes manually positionable louvers whereby the flow of conditioned air moving through the inner frame can be manually controlled when the inner frame is locked to the outer frame.

* * * * *